US007096630B1

(12) United States Patent
Keene et al.

(10) Patent No.: US 7,096,630 B1
(45) Date of Patent: Aug. 29, 2006

(54) COMPOSITE TANGLED FILAMENT MAT WITH OVERLYING LIQUID MOISTURE BARRIER FOR CUSHIONING AND VENTING OF VAPOR, AND FOR PROTECTION OF UNDERLYING SUBFLOOR

(76) Inventors: James R. Keene, 31600 Gates Mills Blvd., Pepper Pike, OH (US) 44124; Michael L. Jackson, 16809 65th Ave. SE., Snohomish, WA (US) 98296

( * ) Notice: Subject to any disclaimer, the term of this patent is extended or adjusted under 35 U.S.C. 154(b) by 86 days.

(21) Appl. No.: 10/676,753

(22) Filed: Oct. 1, 2003

(51) Int. Cl.
*E02D 19/00* (2006.01)

(52) U.S. Cl. ..... 52/309.8; 52/408; 52/309.12; 52/302.1; 52/403.1

(58) Field of Classification Search ..... 52/309.8, 52/408, 403.1, 309.12, 310, 409, 414, 302.1; 156/71
See application file for complete search history.

(56) References Cited

U.S. PATENT DOCUMENTS

| | | | | | |
|---|---|---|---|---|---|
| 2,069,755 | A | * | 2/1937 | Foster | 52/328 |
| 2,388,968 | A | * | 11/1945 | Hedgren | 52/506.05 |
| 2,799,232 | A | * | 7/1957 | Jaeger | 52/409 |
| 2,897,109 | A | * | 7/1959 | Voigtman | 428/153 |
| 3,122,073 | A | * | 2/1964 | Masse | 52/515 |
| 3,686,049 | A | | 8/1972 | Manner et al. | |
| 3,691,004 | A | | 9/1972 | Werner et al. | |
| 3,837,988 | A | | 9/1974 | Hennen et al. | |
| 3,900,102 | A | * | 8/1975 | Hurst | 206/411 |
| 4,010,748 | A | | 3/1977 | Dobritz | |
| 4,073,997 | A | * | 2/1978 | Richards et al. | 442/374 |
| 4,212,692 | A | | 7/1980 | Rasen et al. | |
| 4,315,392 | A | | 2/1982 | Sylvest | 52/309.1 |
| 4,841,705 | A | * | 6/1989 | Fuhrer | 52/410 |
| 5,099,627 | A | | 3/1992 | Coulton et al. | 52/408 |
| 5,224,315 | A | * | 7/1993 | Winter, IV | 52/309.8 |
| 5,230,189 | A | | 7/1993 | Sourlis | 52/169.5 |
| 5,230,192 | A | * | 7/1993 | Webb et al. | 52/395 |
| 5,343,661 | A | | 9/1994 | Sourlis | 52/169.5 |

(Continued)

OTHER PUBLICATIONS

Constroction Canada, Sep. 2000 Issue, pp. 14-16, "Controlling the Transmission of Impact Sound Through Floors" Sep. 2000.

(Continued)

*Primary Examiner*—Carl D. Friedman
*Assistant Examiner*—Basil Katcheves
(74) *Attorney, Agent, or Firm*—Justin S. Rerko, Esq.

(57) ABSTRACT

A composite mat and sheet structure for installation atop a subfloor to underlie a layer of hardenable, cementicious material such as gypsum concrete or Portland concrete that is poured atop the composite structure to harden in situ. The composite structure includes 1) a mat of substantially uniform thickness defined by an array of entangled, intertwined polymeric filaments that twist and turn at random, that are spaced from each other along a majority of their lengths, that preferably are bonded at their randomly located intersections, and that cooperate to give the mat an open-space character well suited for venting vapor from an area beneath the layer of hardenable cementicious material during hardening or curing thereof; and 2) a sheet of barrier material that overlies the mat, is bonded to the mat, and is pervious to water vapor but impervious to water in liquid form, thereby to permit water in vapor form to escape from the hardenable material through the barrier sheet into the mat and to be vented through the open-space area of the mat while the barrier sheet protects the subfloor from damage by water in liquid form that should be confined atop the barrier.

4 Claims, 2 Drawing Sheets

U.S. PATENT DOCUMENTS

| | | | | |
|---|---|---|---|---|
| 5,369,926 | A * | 12/1994 | Borland | 52/302.1 |
| 5,598,673 | A | 2/1997 | Atkins | 52/302.1 |
| 5,937,594 | A | 8/1999 | Sourlis | 52/169.5 |
| 6,023,892 | A | 2/2000 | Sourlis | 52/169.5 |
| RE36,676 | E | 5/2000 | Sourlis | 52/169.5 |
| 6,112,476 | A | 9/2000 | Schulenburg | 52/169.5 |
| 6,131,353 | A | 10/2000 | Egan | |
| 6,167,668 | B1 | 1/2001 | Fine et al. | 52/403.1 |
| 6,256,955 | B1 | 7/2001 | Lolley et al. | 52/302.3 |
| 6,662,504 | B1 | 12/2003 | Krogstad | |

OTHER PUBLICATIONS

Dow Chemical Company, Midland, MI 48674, 5 Pages of Information on "Styrofoam Weathermate Plus," Believed to be Published 2003.

Colbond, Inc, Enka, NC 28728, 4 Pages of Information on Enka-Engineered "Enkasonic Sound Control Matting" Jul. 2001.

Liner Rolpanit Incorporated North America, Toronto M6E3H1, 4 Pages Entitled "Introducing a Unique Solution to Pitch Roof Vapour Control" Believed to be Published 2003.

* cited by examiner

COMPOSITE TANGLED FILAMENT MAT WITH OVERLYING LIQUID MOISTURE BARRIER FOR CUSHIONING AND VENTING OF VAPOR, AND FOR PROTECTION OF UNDERLYING SUBFLOOR

BACKGROUND OF THE INVENTION

In flooring applications, it is known to pour hardenable cementicious materials such as gypsum concrete, Portland concrete containing lightweight aggregate, and the like over a subfloor or other flooring material to harden or cure in situ after being poured.

It is known, for example, that the transmission through floors of noise, such as low frequency noise from impacts, can be diminished in plural story buildings by pouring and curing, in situ, a layer of about 1.0 inches to about 2.0 inches of a hardenable, cementicious material such as gypsum concrete or Portland concrete atop a plywood subfloor. A problem with pouring hardenable cementicious material such as gypsum concrete or Portland concrete or mortar over a subfloor is that, if no steps are taken to prevent liquid moisture from soaking into the subfloor during curing or hardening of the cementicious material, water from the hardenable material will soak downwardly into the subfloor to cause deterioration of the subfloor and may also damage other underlying structure including the ceilings of rooms located beneath the water soaked subfloor. Such moisture also may contribute to mold or other fungal material at or in the flooring, subflooring and underlying ceilings over time.

In U.S. Pat. No. 6,167,668 issued Jan. 2, 2001 to Fine et al, it is proposed that a thinner layer of cementicious material can be poured over a subfloor or other flooring material to harden or set in situ if the relatively thin layer is reinforced with a fiberous mat underlaid by a flexible membrane. The mat/membrane composite serves as a crack preventative and reinforcement structure that can be stapled to the underlying subfloor. The open-space area of the mat is substantially filled with cementicious material when a layer of cementicious material is poured atop the mat. As the cementicious material hardens, cures or otherwise sets up, liquid and vapor from the cementicious material may pass through the membrane.

Floors that incorporate the mat and membrane arrangement proposed in the Fine et al patent make little, if any, use of the open-space area of the mat to vent vapor, such as water vapor, from the hardenable cementicious material during hardening or curing thereof. This lack of venting lengthens the time required to complete the hardening or curing process, and leaves the poured layer of hardenable material wetter than is desired for longer than is desired, which may delay the installation of other flooring materials atop the hardened or cured layer. The membrane of Fine et al is not a barrier that selectively permits water vapor to escape therethrough while selectively confining water in liquid form to the area atop the membrane; and, the open-space area of the mesh or mat of Fine et al is not utilized for venting vapor, but rather is employed to reinforce the layer of hardenable, cementicious material.

BRIEF SUMMARY OF THE INVENTION

The present invention provides a cooperative association of an open-space defining mat (preferably formed from an array of intermingled, randomly oriented filaments that are spaced apart along a majority of their lengths and that are bonded at randomly located intersections where the filaments engage) overlaid by a sheet of liquid barrier material that is selected from materials designed to permit the passage therethrough of vapor such as water vapor (i.e., materials that are pervious to water vapor), and designed to substantially prevent passage therethrough of liquid such as liquid water (i.e., materials that are impervious to water in liquid form).

The mat preferably is flexible enough to permit its being transported in a roll, but rigid enough (referred to herein by the term "semi-rigid") to resist being completely crushed when flooring materials are installed atop the mat. The barrier sheet preferably is flexible enough to be rolled for transport (by itself and when bonded to the mat material), but durable enough so that its permeability to water vapor and its impermeability to liquid water are retained when a composite of the mat and barrier sheet underlie and support a layer of hardenable cementicious material that is poured atop the composite mat and barrier composite to harden (and to support, without being crushed, other flooring material that may be installed atop the hardened cured material together with such loads as may be imposed on the resulting floor).

In one form of preferred practice, a composite mat and sheet structure is provided for installation atop a subfloor directly beneath a layer of cementicious material poured to harden in situ atop the composite mat and barrier sheet structure for venting vapor including water vapor therefrom during hardening of the cementicious material, and for substantially preventing liquid water from the cementicious material from coming into contact with the subfloor. The composite mat and sheet structure includes 1) a flexible, semi-rigid, open-space mat of polymeric material for being installed atop the subfloor and through which vapor including water vapor and air can flow with ease, and 2) a relatively thin sheet of barrier material bonded to upper portions of the mat for providing a barrier that is pervious to vapor including water vapor and air, but that is substantially impervious to liquid moisture so as to permit vapor from the layer of cementicious material poured atop the barrier to pass through the barrier and into the open-space mat for being vented through the mat while substantially blocking passage through the barrier of liquid moisture so as to substantially prevent liquid water from the layer of cementicious material poured atop the barrier from coming into contact with the subfloor.

In preferred practice, the composite mat and sheet structure described just above includes tangled, intertwined, randomly oriented polymeric filaments that twist and turn so as to be spaced from each other along a majority of their lengths, with the filaments being heat bonded or otherwise suitably connected at filament intersections that are randomly located, with spaced upper portions and lower portions of the filaments defining top surface portions and bottom surface portions of the mat that give the mat a substantially uniform thickness, and with the sheet of barrier material being bonded to the top surface portions.

In preferred practice, the composite mat and sheet structure is formed of polymeric filaments that preferably are formed by extrusion of materials including but not limited to polyethylenes, polypropylenes and other polyolefins; polyamides; polyvinyl chlorides; and other thermoplastic polymers, with the filaments being heat bonded or otherwise suitably connected where the filaments randomly intersect. The composite mat and sheet structure preferably has a substantially uniform thickness that falls within the range of about ¼ inch to about ¾ inch, with the mat comprising the majority of this thickness inasmuch as the barrier sheet preferably is a film-like material that preferably has a thickness within the range of about 0.010 inch to about 0.030 inch.

In preferred practice, the sheet of barrier material (which is pervious to vapor, including water vapor and gaseous substances such air, but which is substantially impervious to liquid such as water in liquid form), is very much like what is currently being used as the outer covering of baby diapers—a thin material that will let air and water vapor and the like pass therethrough, but that will substantially prevent the passage therethrough of liquid water or other liquids. Thin film-like materials of this sort have been known for many years and have been employed in a wide variety of applications such as the respiration device that is disclosed in U.S. Pat. No. 4,010,748 issued Mar. 8, 1977 to Dobritz, the disclosure of which is incorporated herein by reference for its discussion of a foil that is impervious to water but pervious to water vapor.

In one form the barrier sheet is a film-like non-woven fabric. In another form, the barrier sheet may take the form of a membrane or other relatively thin material that is porous to moisture vapor, but blocks and impedes the passage of water in liquid form therethrough.

The mat and sheet composite of the present invention, with its mat being formed from a matrix or array of polymeric filaments or fibers arranged to define considerable open space between and among its filaments or fibers, preferably is sufficiently flexible and of open-space character as to provide a cushioning effect to overlying flooring material, such as gypsum concrete poured to harden in situ atop the barrier sheet. Further, as employed in the flooring environment, the mat and sheet composite also acts as a sound absorber to dampen or minimize noise transmission, especially to a subjacent floor level. The mat/sheet composite is especially useful in multi-level floor constructions to cushion, dampen or absorb noise (i.e., to enhance the sound attenuation characteristics of floors between adjacent levels of buildings.)

BRIEF DESCRIPTION OF THE DRAWINGS

These and other features, and a fuller understanding of the invention may be had by referring to the following description and claims, taken in conjunction with the accompanying drawings, wherein:

DESCRIPTION OF PREFERRED EMBODIMENTS

Figure 1:
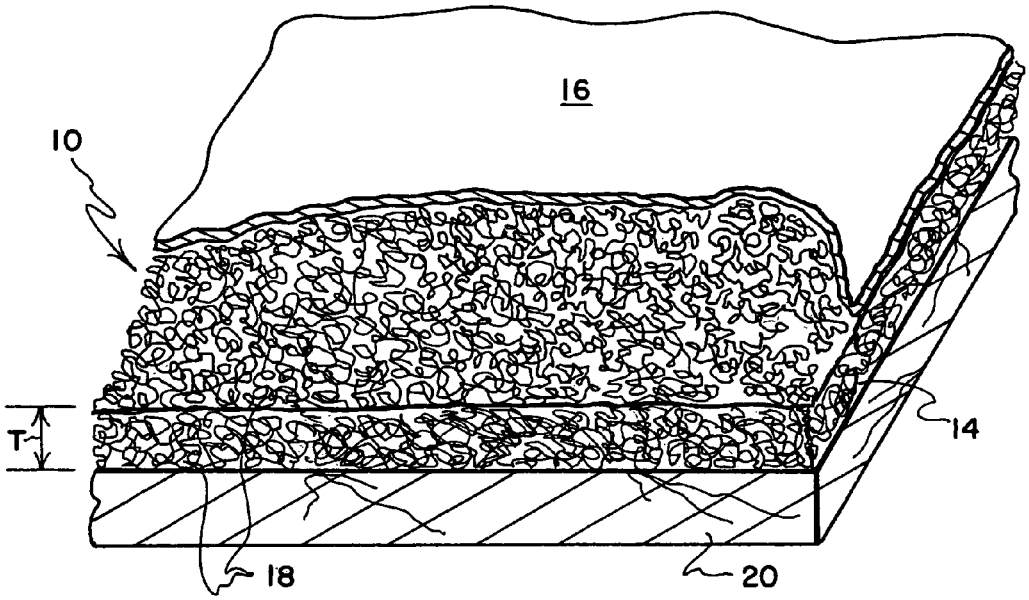
FIG. 1 is a perspective view of a reach of composite mat and moisture barrier sheet material that incorporates one form of the preferred practice of the present invention; and, FIG. 2 is a cross-sectional view of a floor and an adjacent wall area of a dwelling or commercial building wherein the flexible composite mat and moisture barrier sheet material of FIG. 1 is installed, with selected elements of the flooring system being shown slightly exploded for clarity.

Referring to the drawings, there is shown in FIG. 1 at 10 a composite structure that includes a mat 12 formed a tangled, intertwined array of filaments or fibers 14 that turn, twist and curl about at random, that intersect randomly, and that are bonded at random intersections or contact zones 18 as by heat bonding or other suitable bonding or connection technique, thereby to form the unit-handled mat/sheet composite 10.

The filaments or fibers 14 of the composite structure 10 may be of any suitably strong and mildew resistant polymeric material, including but not limited to polyethylenes, polypropylenes and other polyolefins; polyamides; polyvinyl chlorides; and other thermoplastic polymers, with the filaments being heat bonded or otherwise suitably connected where the filaments randomly intersect. The mat 12 may be made to any desired thickness, but for usual flooring purposes, a thickness "T" (see FIG. 1) on the order of about ¼ inch to about ¾ inch is sufficient to provide the desired breathability and venting capability for water vapor, air and other gaseous substances together with cushioning and noise attenuation capabilities. Further, the mat 12 may be treated with anti-microbial or anti-bacterial agents before or at the time of utilization in a flooring construction.

Figure 2:
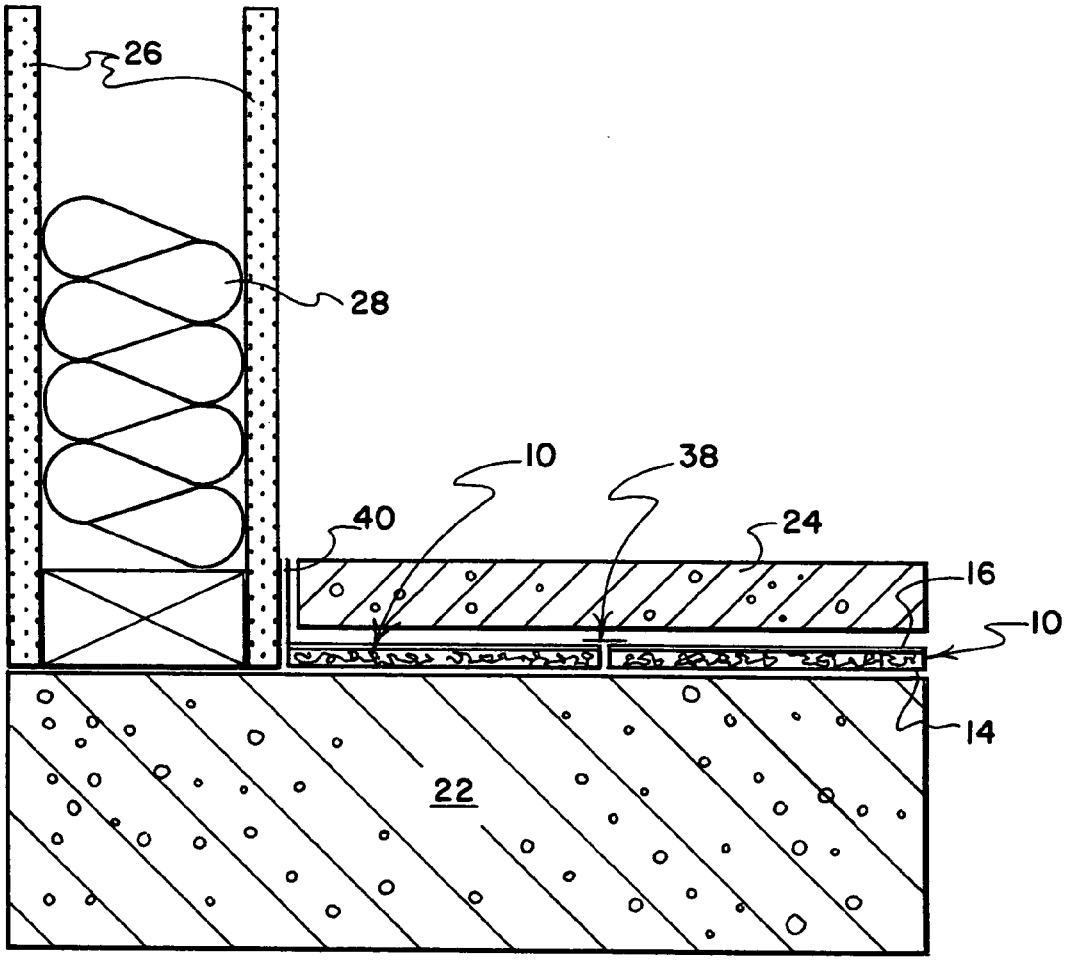

The barrier sheet 16 is preferably a non-woven film-like material that is pervious to water vapor and air but which is substantially impervious to liquid including water in liquid form, so as permit passage therethrough of moisture vapor into the mat 12, while preventing the ready flow of water in liquid form therethrough—whereby the barrier sheet 16 functions to confine liquids such as water to the area atop the barrier sheet 16 wherein a hardenable cementicious material may be poured to harden or cure in situ, as will be explained in conjunction with a discussion of the flooring system depicted in FIG. 2. The non-woven film-like barrier sheet 16 is overlaid onto and bonded to upper surface portions of the mat 16.

The barrier sheet 16 can be purchased from many sources, such as: 1) Liner Rolpanit Incorporated—North America, Toronto, Ontario, Canada M6G 3H1 (website www.linrol.com) which sells a breather membrane highly permeable to vapor and substantially impermeable to liquid water under the trademark ROOFSHIELD; 2) OttoWolff U.S. Sales Group, Chicago, Ill. 6-631 (website ottowolff.de) which sells a similar barrier material under the trademark DIFOLEN -S; and, 3) Scheda Prodotto, Italareni, SRL, 42020 S. Polo D'enza, Via Papa Giovanni XXIII, 14 Italy which sells a similar barrier material under the trademark TECNOFOIL TR-180 and TECNOFOIL NT-100.

The mat/sheet composite structure 10 is semi-rigid and flexible for ease in handling as well as being capable of supporting flooring laid thereover without crushing. Inasmuch as the mat 12 and the barrier sheet 16 each are of substantially uniform thickness, the mat/sheet composite 10 also is of substantially uniform thickness—with the intertwined filaments of the mat 12 constituting the majority of the thickness of the mat/sheet composite 10 inasmuch as the film-like barrier sheet 16 preferably is within the range of about 0.010 inch to about 0.030 inch. The mat/sheet composite may readily be provided in roll or stacked sheet form for ease in handling and application in a flooring system, and may be cut to size as needed to overlie subfloors or floors of substantially any conceivable size or shape.

As seen in FIG. 1, a typical subfloor 20—which may be formed from wood, plywood or the like—is overlaid by the mat/sheet composite structure 10, with the vapor pervious, liquid impervious sheet 16 atop the mat 12—an arrangement quite unlike that employed in the Fine et al patent (referenced previously) wherein a membrane underlies a mat or mesh structure, and wherein the mat or mesh structure extends into cementicious material poured onto and into the mat or mesh so as to serve as a reinforcement thereto.

The employment by the present invention of a water impervious, water vapor pervious barrier sheet 16 atop an entangled filament mat 12 does not preclude the use of a protective film of material beneath the mat/sheet composite 10, but does not require the use of such a film. If desired, a suitable waterproofing layer may be laid upon the subfloor 20 before the mat/sheet composite 10 is placed thereover. The mat 12 also can have another material (not shown) bonded to its bottom surface, for example to enhance sound deadening or for other purposes.

The mat/sheet composite structure 10 may be placed in suitable lengths or sectional units over the subfloor 20. Joints between the abutting edges of adjacent reaches of the mat/sheet composite structures 10 may be taped with duct tape, cellophane tape or other waterproof bonding medium, as indicated in FIG. 2 by the numeral 38, thereby preventing inadvertent lateral separation of the adjacent mat/sheet composite structure reaches, sheets or sections 10. Alternatively, the joints between said abutting edges may be bonded as by using spray adhesive or other suitable materials or techniques.

While a wood subfloor 20 is shown in FIG. 1, the subfloor material is not at all critical nor part of the subject invention. Thus, in FIG. 2, the subfloor or base 22 is shown as concrete, for example, all depending upon the nature of the building being constructed.

What is critical to the invention and what provides such advantages as subfloor protection, vapor venting, cushioning and/or sound deadening benefits, is the character of the mat/sheet composite structure 10 that includes a random filament mat and a water impervious, water vapor pervious mat of the type described for being installed between a subfloor or flooring surface that is overlaid by the composite structure 10, and a poured to harden or cure in situ cementicious material that underlaid by the composite structure, with the barrier sheet atop the mat for permitting vapor such as water vapor to pass downwardly through the barrier sheet and into the open-area of the mat for being vented therethrough. The hardenable material poured to cure or harden in situ atop the barrier layer of the mat/sheet composite structure 10 may comprise any of a variety of commercially available lightweight cementicious materials such as gypsum cement or Portland cement mixed with water and aggregate in the normal manner. The poured layer of hardenable material is typically of the order of one to three inches in thickness, but may be of other thicknesses as are suitable to the particular application. Finish flooring material of substantially any desired type may be installed atop the hardened, set, poured and cured-in-place layer.

It will be seen that, irrespective of the base or subfloor 20 or 22 beneath the mat/sheet composite structure 10, water liquid present in or draining from the overhead poured flooring 24 which may carry cementicious materials cannot pass through the non-woven sheet of barrier material 16 to clog the open matrix of the mat 14. Water vapor, on the other hand, is capable of passing through the barrier sheet 16 and may pass laterally outwardly from the mat 14 to the exterior or interior of the building while leaving the mat open and unclogged for vapor passage.

Further, the open filamentary matrix construction of the mat/sheet composite structure 10 also provides sound control so as to limit transmission through a floor structure of undesirable sounds such as impact noise and other low, mid and high frequency sounds, for example within the range of about 100 Hz to about 3150 Hz. The mat/sheet composite structure 10 preferably also performs a limited degree of cushioning of the flooring material that is installed atop the mat/sheet composite structure 10.

Further, the mat/sheet composite structure 10 by virtue of the open filamentary matrix construction also provides sound control in lower frequencies to limit impact noise, especially when the flooring lies above a lower floor of a building, and preferably also performs a limited degree of cushioning of the flooring material that is installed atop the mat/sheet composite structure 10.

The mat 12 is preferably treated with an anti-microbial and anti-fungal agent for the purpose of inhibiting any growth of mildew at the subfloor or in the mat area generally.

In FIG. 2, there is also shown for illustrative purposes in addition to adjacently installed reaches of the mat/sheet composite structure 10 laid atop a concrete floor structure 22, a typical end wall arrangement including laterally spaced vertical outer gypsum board or drywall panels 26, and illustrative insulative batting 28. The mat/sheet composite structure 10 is butted against a perimeter isolation material 40 that permits vapor to be vented from the open-area of the mat 14 of the composite structure 10 upwardly into the atmosphere of a room of the building. The perimeter isolation material 40 extends around the perimeter of the walls of the room.

While polymeric filaments are preferred for the intertangled mass forming the mat 12, as illustratively shown by U.S. patents to Voigtman U.S. Pat. No. 2,897,109 or Sylvest U.S. Pat. No. 4,315,392, the disclosures of which are incorporated herein by reference. The material from which the mat 16 is formed may agree with what is depicted in FIG. 14 of Sourlis U.S. Pat. Nos. 5,230,189, 5,343,661 and RE-36,676, and may be consistent with what is disclosed in these patents about such material, the disclosures of which patents are incorporated herein by reference. It is within the scope of the invention to employ other materials now known and hereafter existing that are capable of fulfilling the requisite structure and function, to provide an open matrix of material that will perform as described.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

The invention claimed is:

1. A flooring system comprising a subfloor, a flexible, semi-rigid, open-space mat of tangled polymeric filaments overlying the subfloor, a sheet of barrier material overlying the mat, and a layer of hardenable material poured atop the sheet of barrier material to harden in situ atop the sheet of barrier material, wherein the sheet of barrier material is pervious to vapor but is substantially impervious to liquid so as to permit vapor to pass through the sheet of barrier material and to be vented through the open-space mat during hardening of the hardenable material, and to substantially prevent liquid from passing through the sheet of barrier material and from coming into contact with the subfloor.

2. The flooring system of claim 1 wherein the sheet of barrier material is bonded to upper portions of the mat.

3. The flooring system of claim 1 wherein the polymeric filaments that form the mat are selected from a group consisting of polyolefins, polypropylenes, polyethylenes, polyamides and polyvinylchlorides, and the filaments of the mat are heat bonded at intersections thereof that are randomly located throughout the mat.

4. The flooring system of claim 1 wherein the hardenable material is gypsum concrete.

* * * * *